US011932441B1

(12) United States Patent
Kick

(10) Patent No.: US 11,932,441 B1
(45) Date of Patent: Mar. 19, 2024

(54) CONTAINER

(71) Applicant: Merrilee Kick, Plano, TX (US)

(72) Inventor: Merrilee Kick, Plano, TX (US)

( * ) Notice: Subject to any disclaimer, the term of this patent is extended or adjusted under 35 U.S.C. 154(b) by 0 days.

(21) Appl. No.: 18/506,811

(22) Filed: Nov. 10, 2023

Related U.S. Application Data

(63) Continuation of application No. 29/824,813, filed on Jan. 27, 2022, now abandoned, which is a continuation of application No. 16/800,195, filed on Feb. 25, 2020, now Pat. No. 11,338,955, which is a continuation of application No. 12/762,934, filed on Apr. 19, 2010, now Pat. No. 10,604,296.

(51) Int. Cl.
*B65D 1/16* (2006.01)
*B65D 17/28* (2006.01)

(52) U.S. Cl.
CPC ..... *B65D 1/165* (2013.01); *B65D 1/16* (2013.01); *B65D 17/4012* (2018.01)

(58) Field of Classification Search
CPC ... B65D 1/10; B65D 1/12; B65D 1/14; B65D 1/16; B65D 1/165; B65D 17/4012; B65D 2501/00; B65D 2501/0009
USPC ..... 220/269, 608, 669
See application file for complete search history.

(56) References Cited

U.S. PATENT DOCUMENTS

| | | | |
|---|---|---|---|
| D49,555 | S | 8/1916 | Vivaudou |
| D106,034 | S | 9/1937 | Harrison |
| 2,745,642 | A | 5/1956 | Hermann |
| 3,179,036 | A | 4/1965 | Jackson |
| 3,314,569 | A | 4/1967 | Seiferth |
| D223,898 | S | 6/1972 | Edwards |
| D224,516 | S | 8/1972 | Amberg |
| D235,193 | S | 5/1975 | Edwards |
| D254,716 | S | 4/1980 | Mascia |
| 4,936,482 | A | 6/1990 | Gallagher et al. |
| D352,898 | S | 11/1994 | Vacher |
| 5,407,086 | A | 4/1995 | Ota |
| D383,646 | S | 9/1997 | Jeppesen |
| D448,666 | S | 10/2001 | Fields |
| 6,375,031 | B1 | 4/2002 | Kwan |
| D460,693 | S | 7/2002 | Flowers |

(Continued)

FOREIGN PATENT DOCUMENTS

| | | | |
|---|---|---|---|
| JP | 05032248 | A | 2/1993 |
| JP | D1608809 | S | 7/2021 |

(Continued)

OTHER PUBLICATIONS

Translation of Office Action with Search Report for Taiwanese Design Patent Application No. 111301016, dated Aug. 31, 2022; 3 pages.

*Primary Examiner* — John K Fristoe, Jr.
*Assistant Examiner* — Madison L Poos
(74) *Attorney, Agent, or Firm* — HAYNES AND BOONE, LLP

(57) ABSTRACT

A container for storing a liquid or a solid may include a container body having a container side wall and a container bottom and a container lid having a pop top arm to pivot and cooperate with a weakened area to provide access to the interior of the container body. The container body may be formed from plastic and the container lid is formed from metal, and the container body may include a vertical neck. The container body may include a lip, and the bottom wall may include a center protrusion. The bottom wall may include a depression, and the bottom wall may include a radial extending depression.

20 Claims, 9 Drawing Sheets

Side View - Lid & Lip of Container
(Note: The lip and lid are enlarged to show hook)

(56) References Cited

U.S. PATENT DOCUMENTS

| | | | |
|---|---|---|---|
| 6,574,883 | B2 | 6/2003 | Giblin et al. |
| 6,793,094 | B2 | 9/2004 | Turnbough |
| D512,917 | S | 12/2005 | Frisch et al. |
| 7,051,892 | B1 | 5/2006 | O'Day |
| D562,685 | S | 2/2008 | Millspaw et al. |
| D565,413 | S | 4/2008 | Honkawa et al. |
| D596,489 | S | 7/2009 | Weiss |
| D606,404 | S | 12/2009 | Diss |
| D606,405 | S | 12/2009 | Takata et al. |
| D612,732 | S | 3/2010 | Takata et al. |
| D614,971 | S | 5/2010 | Millspaw et al. |
| 7,731,053 | B2 | 6/2010 | Ivey |
| 7,784,639 | B2 | 8/2010 | Milkowski et al. |
| D634,635 | S | 3/2011 | Araujo et al. |
| D650,280 | S | 12/2011 | de Peyerimhoff et al. |
| D663,619 | S | 7/2012 | Pillet |
| D675,528 | S | 2/2013 | Beaver |
| D699,578 | S | 2/2014 | Marina et al. |
| D701,767 | S | 4/2014 | Marina et al. |
| D703,068 | S | 4/2014 | Kick |
| D704,567 | S | 5/2014 | Sanders |
| D711,247 | S | 8/2014 | Sanders |
| D732,978 | S | 6/2015 | Kick |
| D739,267 | S | 9/2015 | Kick |
| 9,522,482 | B2 | 12/2016 | Milkowski et al. |
| D803,376 | S | 11/2017 | Gobber et al. |
| 10,336,496 | B2 | 7/2019 | Zimmer |
| 10,604,296 | B2 | 3/2020 | Kick |
| D889,266 | S | 7/2020 | Pun |
| 11,484,152 | B2 | 11/2022 | Kick |
| D976,704 | S | 1/2023 | Stammen |
| 2014/0061328 | A1 | 3/2014 | Haymond |
| 2015/0344177 | A1 | 12/2015 | Kick |
| 2019/0009952 | A1 | 1/2019 | Pedmo et al. |
| 2020/0262601 | A1 | 8/2020 | Kick |

FOREIGN PATENT DOCUMENTS

| | | | |
|---|---|---|---|
| KR | 3006720360000 | S | 1/2014 |
| TW | D180616 | S | 1/2017 |
| WO | WO-2005049434 | A1 | 6/2005 |
| WO | WO-2006029441 | A1 | 3/2006 |
| WO | WO-2009072910 | A2 | 6/2009 |

Thickness of Sidewalls & Volume

View:
Bottom of Container

CONTAINER

CROSS-REFERENCE TO RELATED APPLICATIONS

This application is a continuation of U.S. application Ser. No. 29/824,813, filed on Jan. 27, 2022, which is a continuation of U.S. application Ser. No. 16/800,195, filed on Feb. 25, 2020, now U.S. Pat. No. 11,338,955, which is a continuation of U.S. application Ser. No. 12/762,934, filed on Apr. 19, 2010, now U.S. Pat. No. 10,604,296, the entire disclosures of which are hereby incorporated herein by reference.

FIELD OF THE INVENTION

The present invention relates to containers and more particularly to a container having a body which may be formed from plastic and a lid which may be formed from metal.

BACKGROUND

Containers having an easy-open-end have been used with a metal lid and container in order to provide a source of merchandising beer and soda for a number of years. These metal containers are formed from cutting metal and folding the metal to an appropriate shape. Metal however does not lend itself well to being molded, and making a new shape by designing a mold out of the sheet of metal is time-consuming and expensive. Thus, it is difficult to achieve any type of design in order to increase the desirability of the package/container with a metal container. However, the pop top lid is very popular with consumers and fairly inexpensive to purchase. Plastic containers have been molded into various shapes and may include various designs in order to increase the attractiveness of the container.

SUMMARY

A container for storing a liquid or a solid may include a container body having a container side wall and a container bottom, and may include a container lid having an easy-open "pop-top arm" which cooperates with a weakened (scored metal) area which provides access to the interior of the container body. The container may also operate with no lid.

The container body may be formed from plastic and the container lid is formed from metal, and the container body may include a vertical or slightly angled neck. The container body may include a lip, and the bottom wall may include a center protrusion or concave shape. The bottom wall may include a depression, and the bottom wall may include a radial extending depression.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention combines the flexibility and desirability of a container body 105 which may be formed from molding plastic or other appropriate material and a metal lid to cooperate with the container body which may include a pop top (or easy-open) lid 131 to provide access to the user of the contents of the container body.

Figure 1:
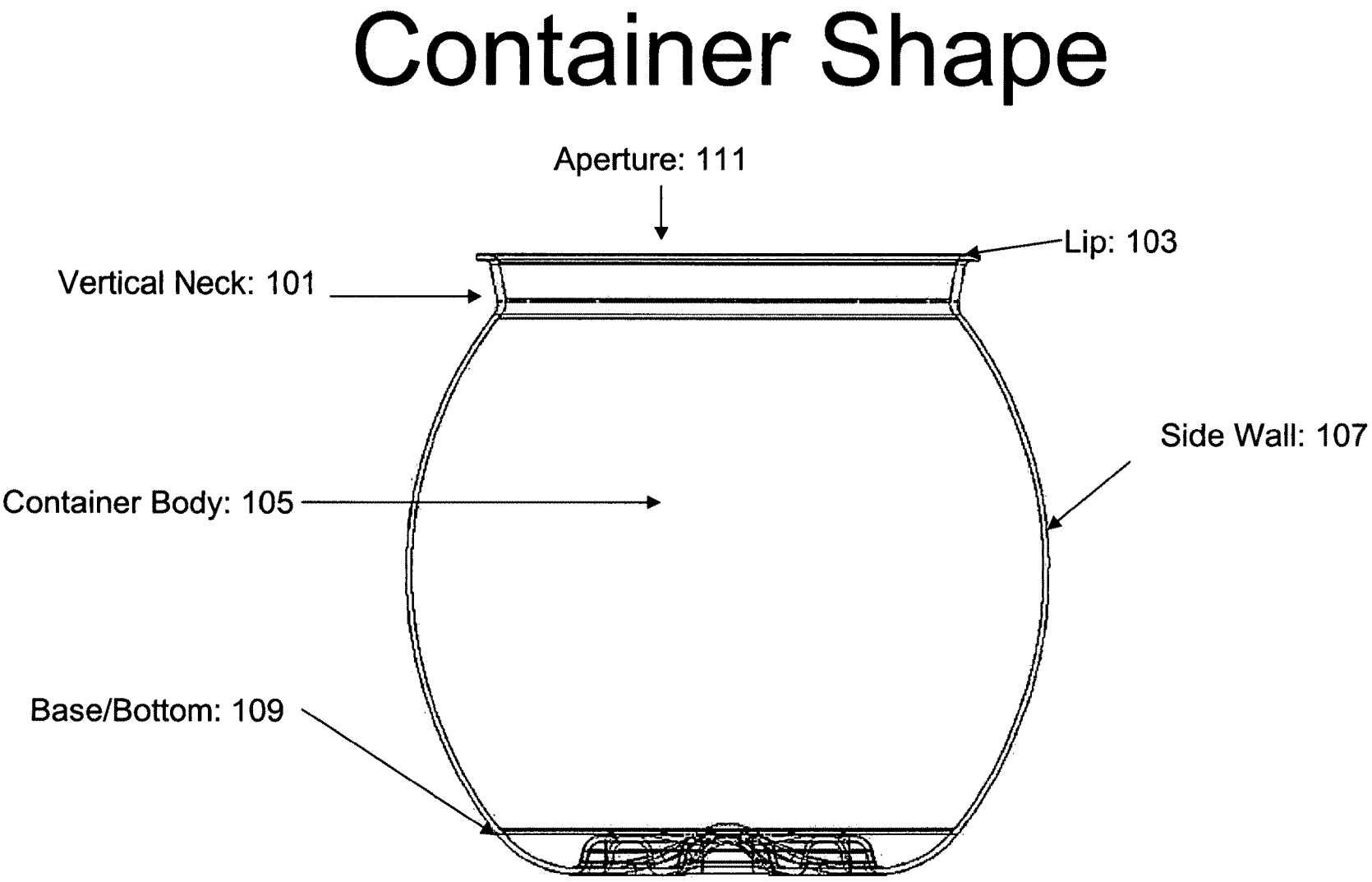
FIG. 1 illustrates a side view of the container body of the present invention.

FIG. 1 illustrates a side view of the container body 105 which may include a side wall 107 which may extend radially around a periphery of the container body 105 and may include a convex side wall 107 or a concave side wall (not shown). The container body 105 may be shaped as a truncated spherical body. The container body 105 may be hollow in order to provide for a solid or liquid which may be dispensed to the user.

The distal end of the container side wall 107 may be connected to a base/bottom wall 109 in order to seal the first end of the container 105 and the proximate end of the container side wall 107 may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (Not shown on FIG. 1, but it is seen on FIGS. 4, 5, and 6) in order to provide a seal so that the liquid or solid within the container body 105 does not leak out.

The container body 105 according to the present invention may be made of an appropriate plastic/synthetic resin, typically polyethylene terephthalate (PET) resin. Alternatively, however, the container 105 may be made from polyamide resin, polycarbonate resin, polyacetal resin, polybutylene terephthalate resin or other synthetic resin having a sufficient resistance to chemicals. The container may be formed by known molding processes, such as biaxial orientation blow molding process or direct blow molding process or injection blow molding.

Figure 2:
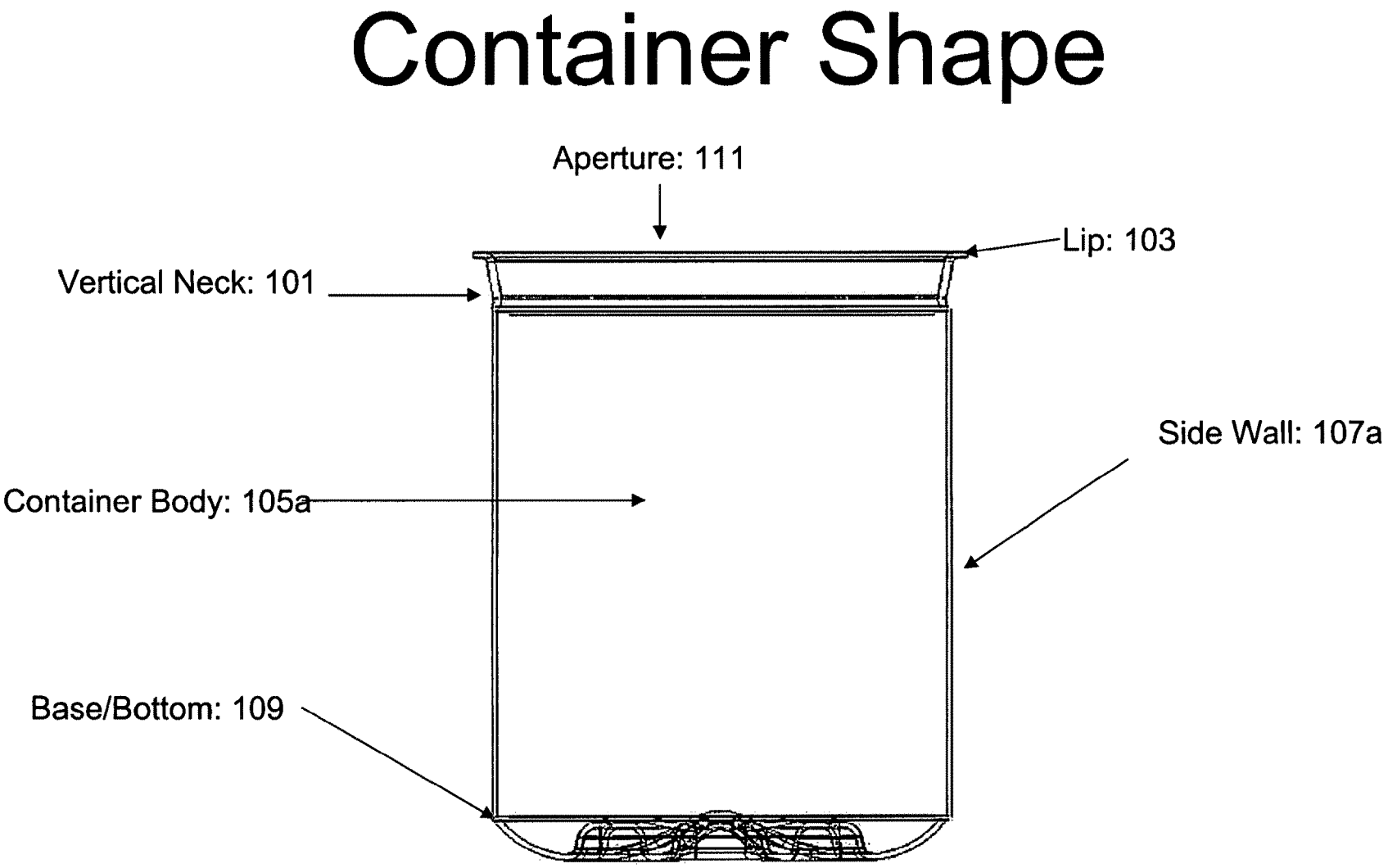
FIG. 2 illustrates a side view of another container body of the present invention.

FIG. 2 illustrates a side view of another container body 105*a* which may include a cylinder side wall 107*a* which may extend radially around a periphery of the container body 105*a* and may include a substantially vertical side wall 107*a*. The container body 105*a* may be hollow in order to provide for a solid or liquid which may be dispensed to the user. The distal end of the container side wall 107*a* may be connected to a base/bottom wall 109 in order to seal the first end of the container 105*a* and the proximate end of the container side wall 107*a* may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (not shown in FIG. 2) in order to provide a seal so that the liquid or solid within the container body 105*a* does not leak out.

The container body of 105*a* may be formed from molded plastic and may be integral without seams or portions of the container body may be formed from molded plastic in sections which may be glued, welded or otherwise attached together.

The container body 105*a* according to the present invention may be made of an appropriate plastic/synthetic resin, typically polyethylene terephthalate (PET) resin. Alternatively, however, the container 105*a* may be made from polyamide resin, polycarbonate resin, polyacetal resin, polybutylene terephthalate resin or other synthetic resin having a sufficient resistance to chemicals. The container may be formed by known molding processes, such as biaxial orientation blow molding process or direct blow molding process or injection blow molding.

Figure 3:
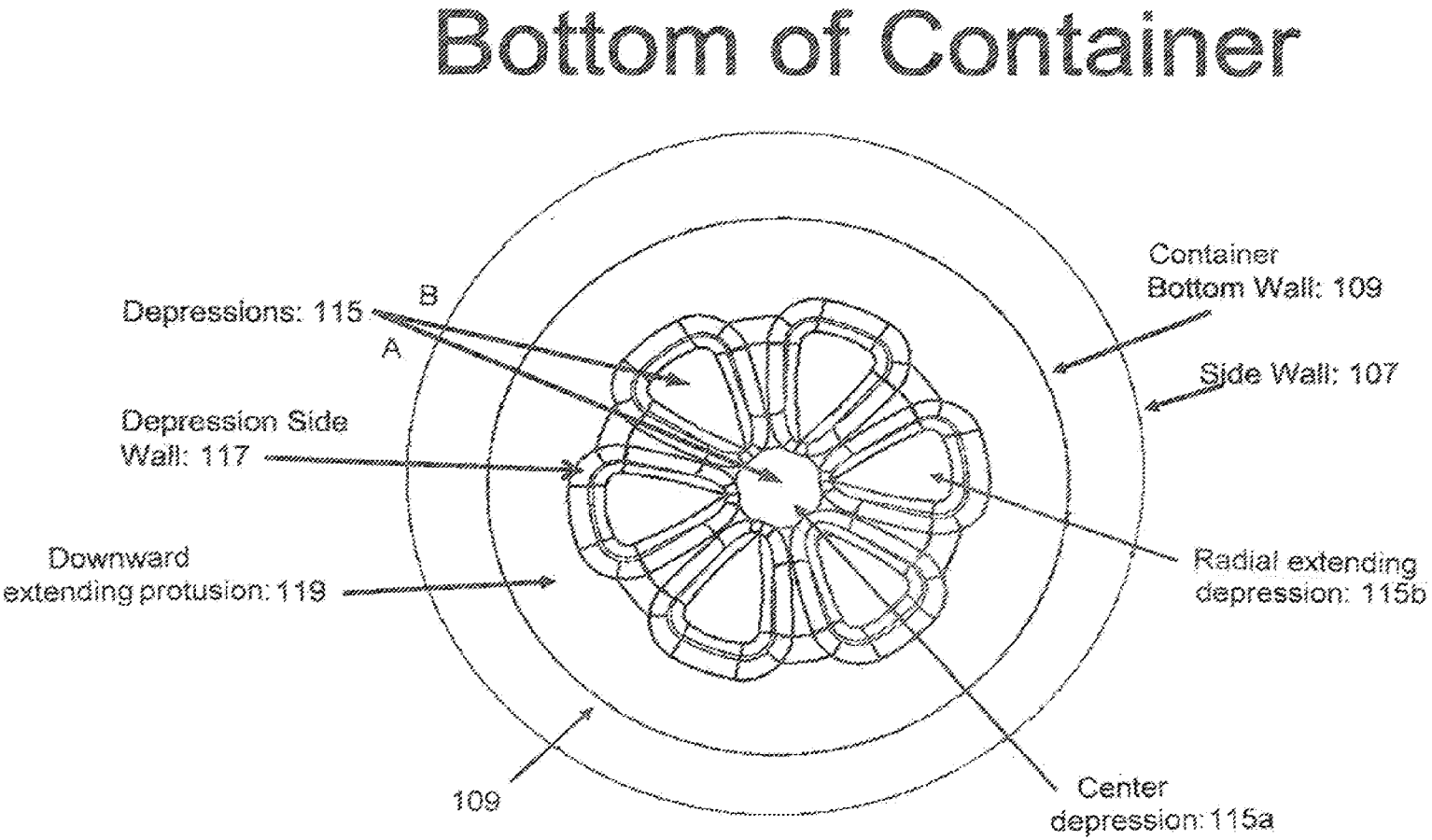
FIG. 3 illustrates a bottom view of the container body of the present invention.

FIG. 3 illustrates a bottom view of the container body and illustrates the container side wall 107 extending radially outwards and illustrates the bottom wall 109 which may be connected to the container side wall 107. The bottom wall 109 may include a multitude of radially extending depressions 115 which may increase in width as the radial distance from the center increases. The depression 115 may be defined by a depression side wall 117 which extends around the periphery of the depression 115. The bottom wall 109 may include a downward extending protrusion 119 which may be centered with respect to the depressions 115 and the bottom wall 109.

Figure 4:
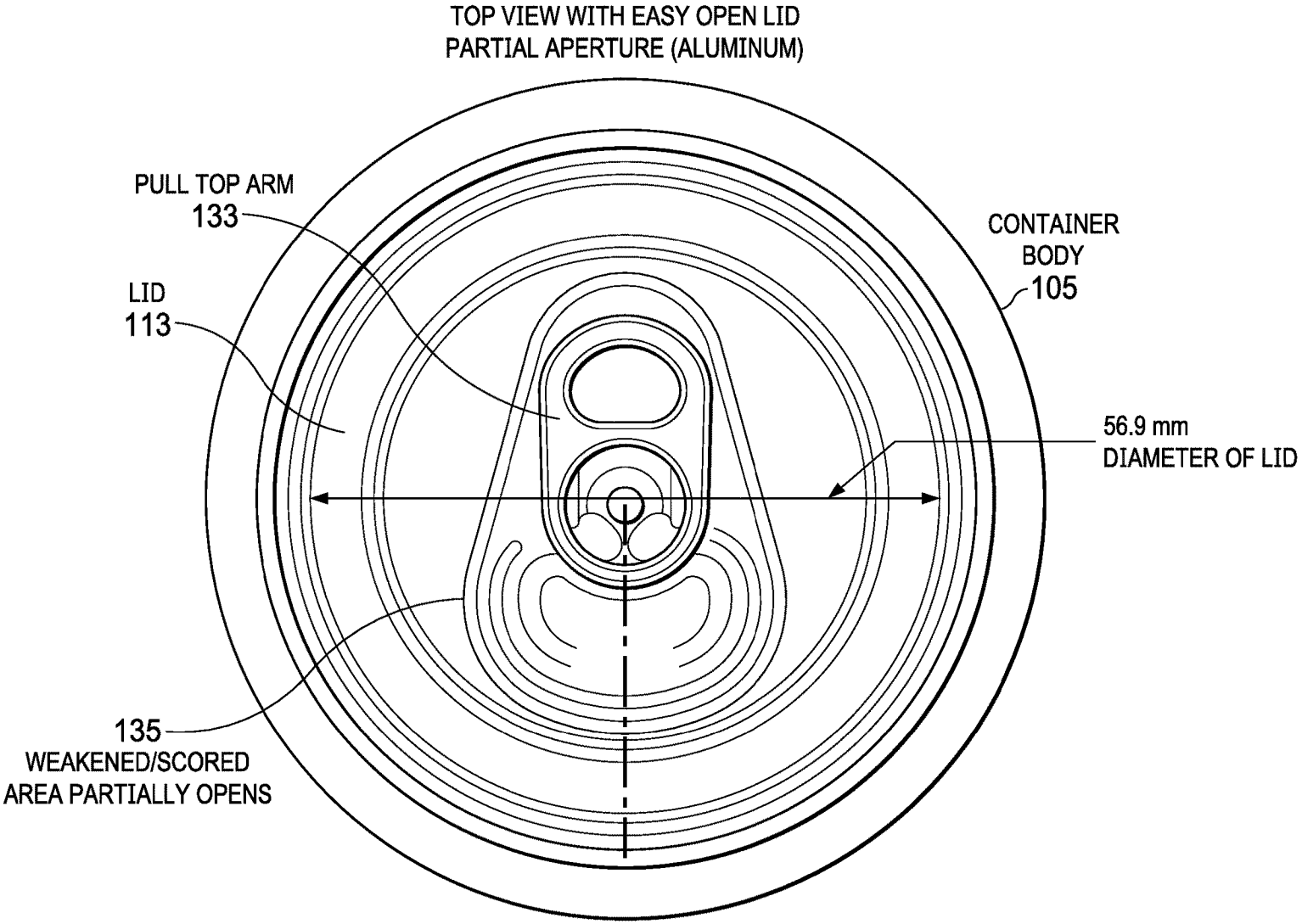
FIG. 4 illustrates a top view of the lids and container body of the present invention.

FIG. 4 illustrates a top view of the container which may include the container body 105 and the container lid 113 which may be deformable in order to provide access to the contents of the container body 105. The container lid 113 may be formed from metal such as steel, aluminum or other types of metals and may include a weakened (or scored) area 135 which deforms and provides an opening when the 'pull top' arm 133 which may include an aperture for a finger of the user and may be pivoted by the user. The weakened/scored area 135 may partially open to provide access to the contents of the container.

Figure 5:
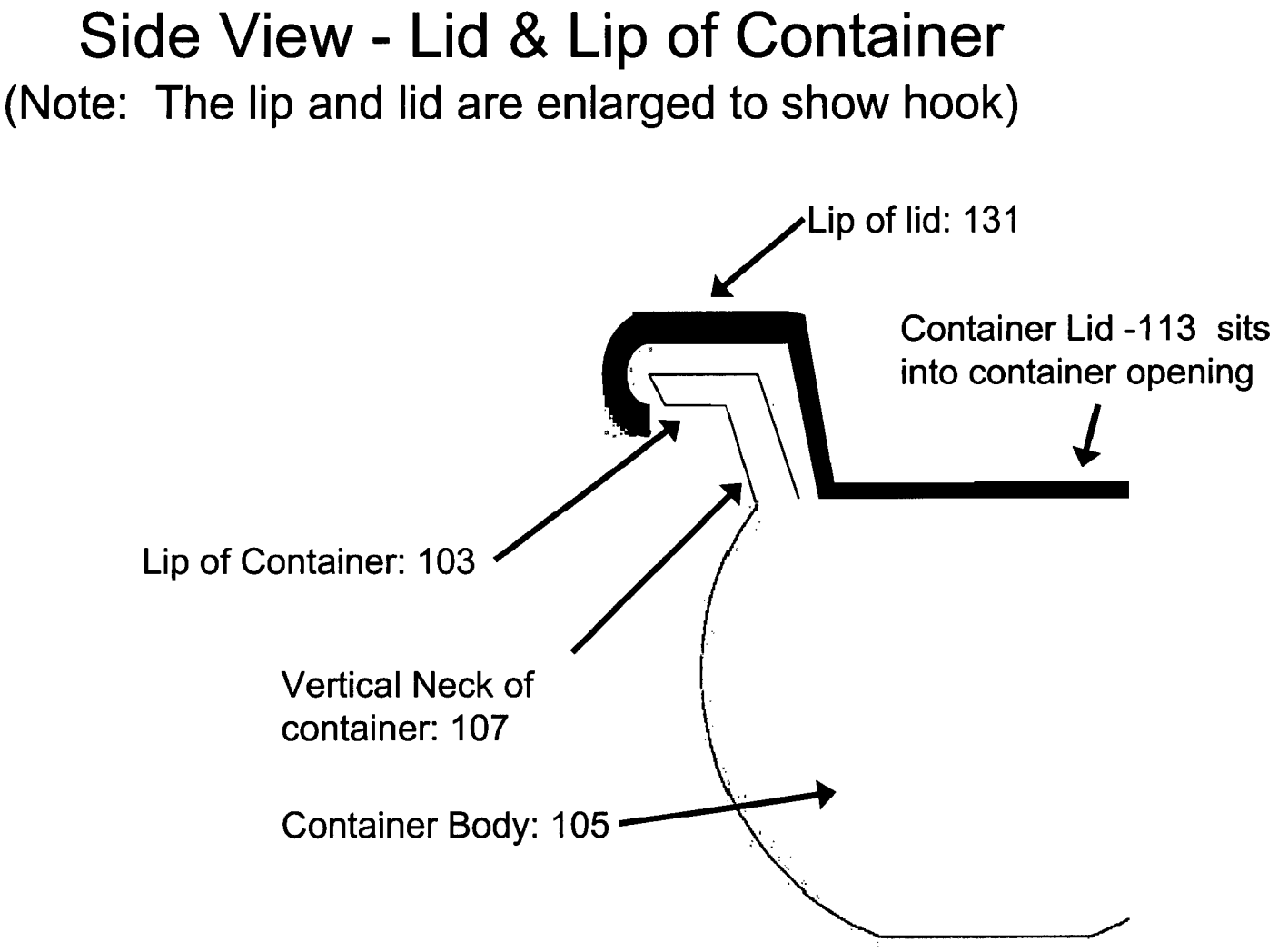
FIG. 5 illustrates a section of the lid and lip of the container body of the present invention.

FIG. 5 illustrates a side view of the container lid 103 which may extend over the vertical neck 107 and may extend around the lip 131 in order to provide a substantially watertight seal/airtight seal for the contents of the container body 105.

Figure 6:
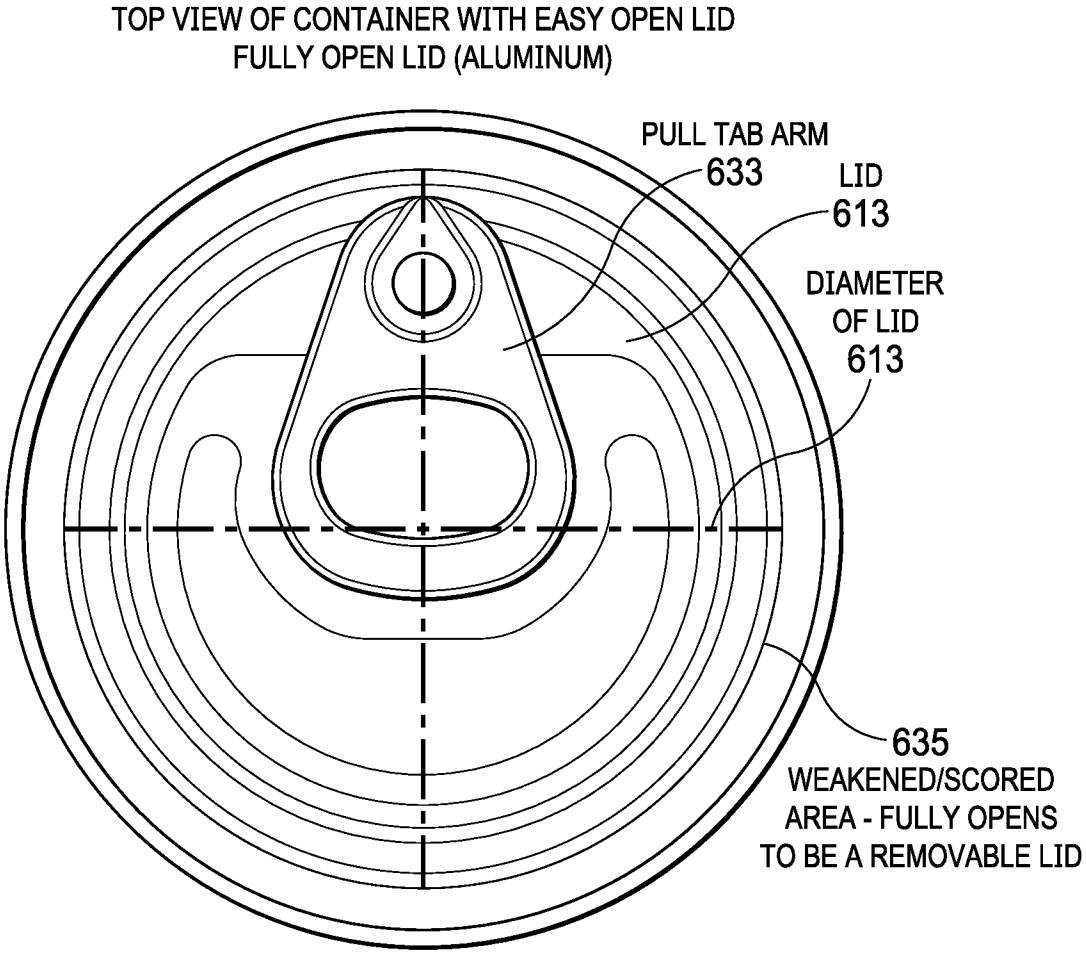
FIG. 6 illustrates another lid for the container body of the present invention.

FIG. 6 illustrates another container lid of the present invention. The container lid 613 may be formed from metal such as steel, aluminum or other types of metals and may include a weakened (or scored) area 635 which deforms and provides an opening when the 'pull tab' arm 633 which may include an aperture for a finger of the user and may be pivoted by the user. The weakened area 635 may extend substantially across the entire lid 613 to provide a full aperture lid to allow the user to add other contents to the container.

Figure 7:
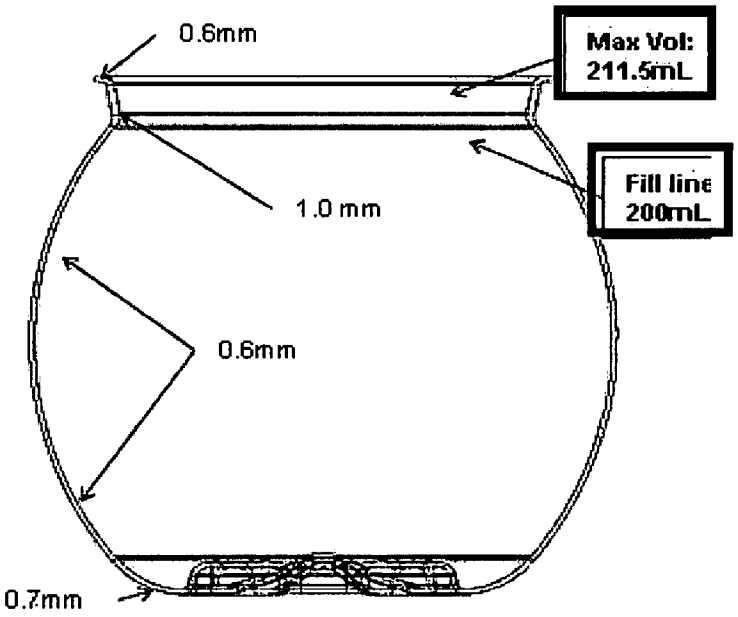
FIG. 7 illustrates the thicknesses of the plastic sidewalls, neck, and flange of the rounded container, and the volume of the rounded container.

FIG. 7 illustrates the thicknesses of the plastic sidewalls, neck and flange. This also illustrates the maximum volume of fluid, and the location for the "fill line" during the container filling process.

Figure 8:
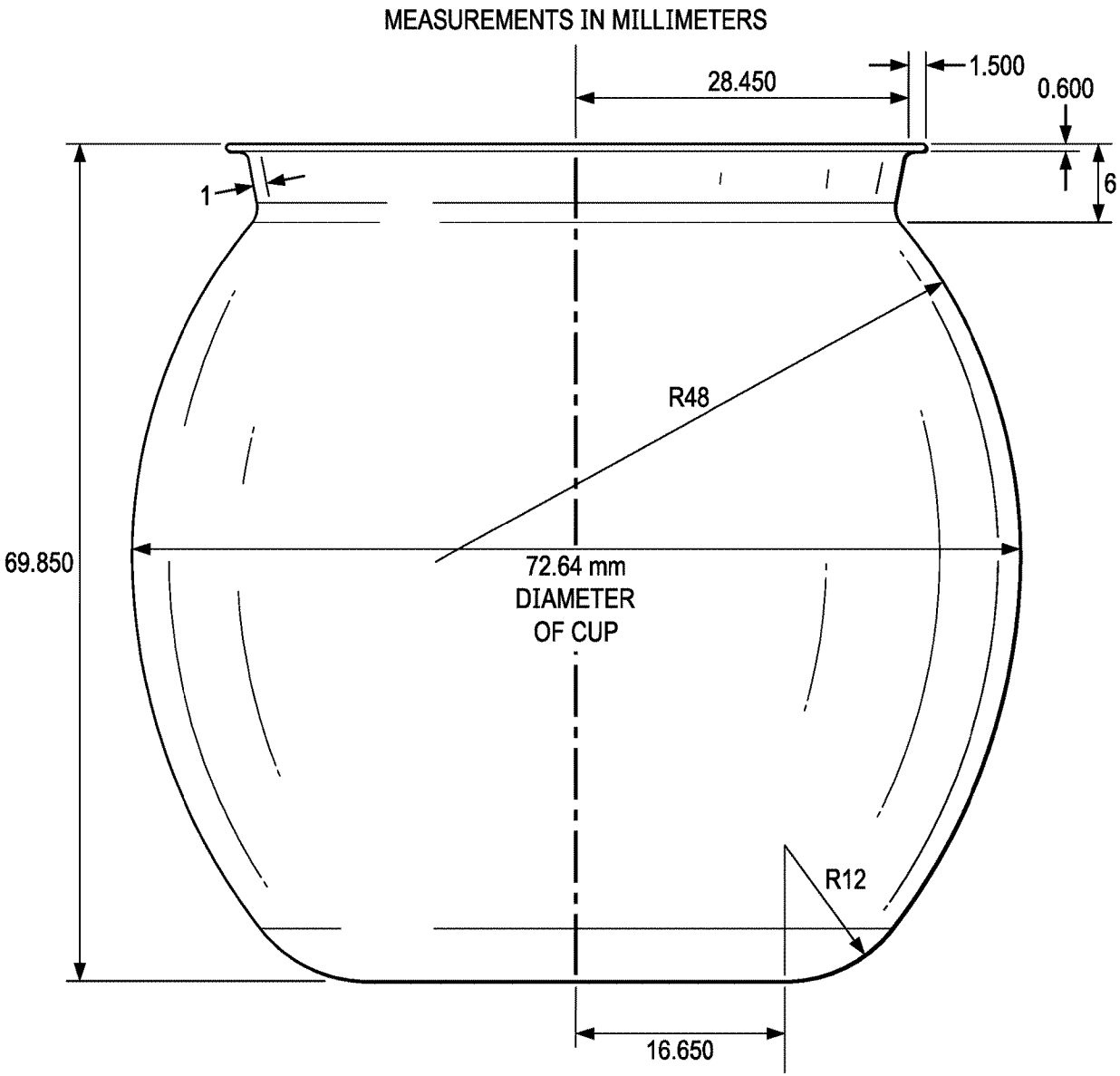
FIG. 8 illustrates the general dimensions of the rounded container in millimeters.

FIG. 8 illustrates the general dimensions of the rounded container in millimeters (cylindrical container measurements not shown from FIG. 2).

Figure 9:
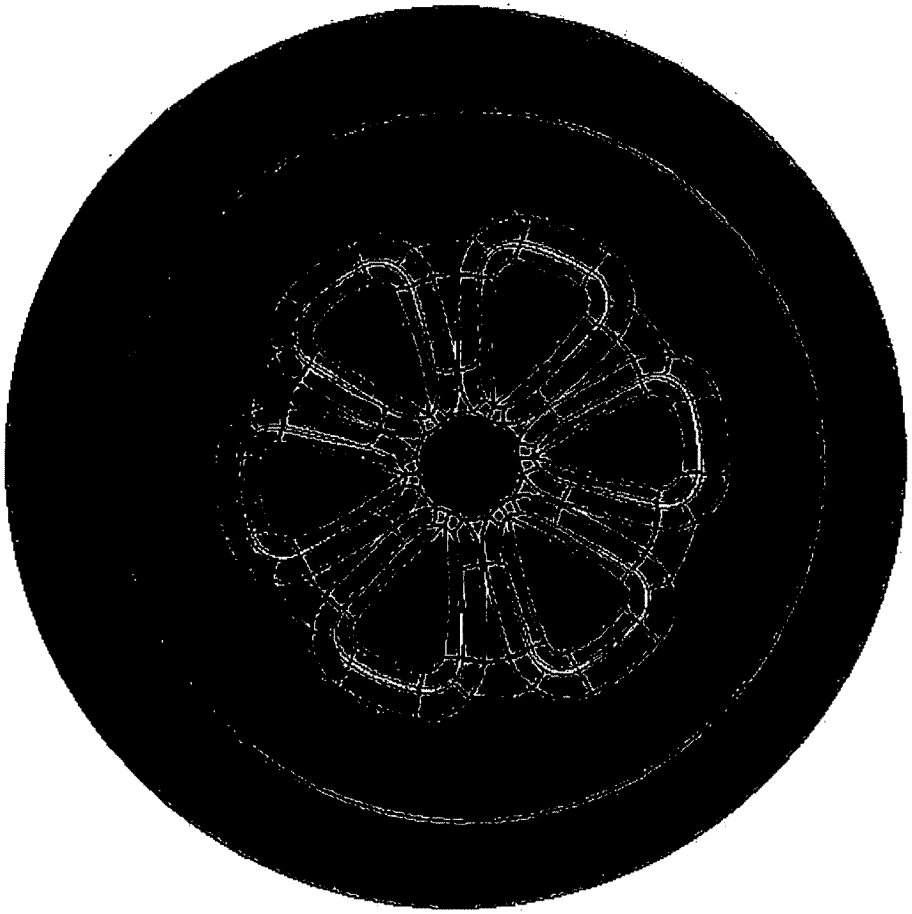
FIG. 9 illustrates a bottom view of the rounded container.

FIG. 9 illustrates the bottom view of the container.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A container, comprising:

a container body, the container body defining a first opening to an interior of the container body; and a lid connected to the container body and covering the first opening to the interior of the container body;

wherein the container body is made out of a resin;

wherein the lid is made out of a metal;

wherein the container body comprises a container side wall and a base portion connected to the container side wall;

wherein the base portion comprises a bottom and a first depression formed therein, the first depression extending upwardly from the bottom;

wherein the first depression at least partially defines a first outline;

wherein the base portion further comprises a center element centered with respect to the first outline at least partially defined by the first depression;

wherein each of the center element, and the first outline at least partially defined by the first depression, is centered with respect to the container side wall;

wherein each of the center element, and the first outline at least partially defined by the first depression, is centered with respect to the base portion;

wherein a cross-sectional diameter of the first opening to the interior of the container body is less than a cross-sectional diameter of a middle portion of the container side wall;

wherein the base portion defines a diameter that is less than the cross-sectional diameter of the middle portion of the container side wall;

wherein a lower portion of the container side wall extends downwardly from the middle portion of the container side wall to the base portion of the container body, the lower portion along its entirety being greater in diameter than the base portion, including the bottom, thereby rendering the container body stemless;

wherein the container body further comprises a circular neck extending from the container side wall so that the container side wall extends between the circular neck and the base portion;

wherein an upper edge of the container side wall is adjacent to the circular neck of the container body;

wherein the container body further comprises a lip at an end of the circular neck opposite the upper edge of the container side wall;

wherein the circular neck is adjacent to the lip;

wherein a first portion of the lid is above the lip of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein the first circular shape defined by the first portion of the lid is radially positioned between the container side wall and the second circular shape defined by the first portion of the lid;

wherein a second portion of the lid extends horizontally and is positioned so that the second circular shape is radially positioned between the second portion of the lid and the first circular shape;

wherein the second portion of the lid defines a total area across which the second portion of the lid extends horizontally;

wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape;

wherein the arm comprises opposing first and second end portions;

wherein the arm is pivotable from a first position, in which the arm extends horizontally and the weakened or scored area is not deformed, to a second position, in which the arm does not extend horizontally and the weakened or scored area is deformed to provide a second opening to the interior of the container body;

wherein an upper portion of the container side wall extends upwardly from the middle portion of the container side wall to the upper edge of the container side wall, the upper portion along its entirety being greater in diameter than the first opening to the interior of the container body;

wherein the container body contains a liquid therewithin;

wherein the lid cooperates with the lip to provide a seal so that the liquid contained within the container body is sealed against leaking out from between the container body and the lid;

wherein, when the arm of the lid is in the first position and the weakened or scored area is not deformed:

the first end portion of the arm is not positioned above the weakened or scored area of the second portion of the lid; and at least a portion of the second end portion of the arm is positioned above the weakened or scored area of the second portion of the lid;

wherein the container side wall extends between the circular neck and the base portion so that:

the upper portion of the container side wall defines a first angle:

between the upper portion of the container side wall and the bottom of the base portion, and with respect to the bottom of the base portion;

the middle portion of the container side wall defines a second angle:

between the middle portion of the container side wall and the bottom of the base portion, and with respect to the bottom of the base portion;

the lower portion of the container side wall defines a third angle:

between the lower portion of the container side wall and the bottom of the base portion, and with respect to the bottom of the base portion;

the first angle is an acute angle;

the third angle is an obtuse angle;

the second angle is greater than the first angle; and the third angle is greater than the second angle;

and wherein the interior of the container body extends continuously across the cross-sectional diameter of the middle portion at a height midway between the circular neck and the base portion so as to be interrupted, if at all, only by the liquid contained within the container body.

2. The container of claim 1, wherein the resin is a polyethylene terephthalate (PET) resin.

3. The container of claim 1, wherein the container body is formed using a blow molding process.

4. The container of claim 1, wherein the metal is aluminum.

5. The container of claim 1, wherein the metal is aluminum; and wherein the resin is a polyethylene terephthalate (PET) resin.

6. The container of claim 1, wherein the container body is formed using a blow molding process; and wherein the resin is a polyethylene terephthalate (PET) resin.

7. The container of claim 1, wherein the metal is aluminum; and wherein the container body is formed using a blow molding process.

8. The container of claim 1, wherein the metal is aluminum;

wherein the resin is a polyethylene terephthalate (PET) resin; and wherein the container body is formed using a blow molding process.

9. The container of claim 1, wherein the first depression is visible through at least a portion of the container body;

wherein the base portion further comprises a second depression adjacent the first depression; and wherein the second depression is visible through the at least a portion of the container body.

10. The container of claim 1, wherein at least a portion of the container body is transparent;

wherein the first depression is visible through the at least a portion of the container body;

wherein the base portion further comprises a second depression adjacent the first depression; and wherein the second depression is visible through the at least a portion of the container body.

11. The container of claim 1, wherein the center element of the base portion is a downward extending protrusion.

12. The container of claim 1, wherein the base portion further comprises a second depression adjacent the first depression; and wherein the second depression at least partially defines the first outline.

13. The container of claim 1, wherein the center element of the base portion is a downward extending protrusion; and wherein the base portion further comprises a second depression adjacent the first depression.

14. The container of claim 13, wherein the second depression at least partially defines the first outline.

15. A container, comprising:

a container body, the container body defining a first opening to an interior of the container body; and a lid connected to the container body and covering the first opening to the interior of the container body;

wherein the container body is made out of a resin;

wherein the lid is made out of a metal;

wherein the container body comprises a container side wall and a base portion connected to the container side wall;

wherein the base portion comprises a bottom and a first depression formed therein, the first depression extending upwardly from the bottom;

wherein the first depression at least partially defines a first outline;

wherein the base portion further comprises a center element centered with respect to the first outline at least partially defined by the first depression;

wherein each of the center element, and the first outline at least partially defined by the first depression, is centered with respect to the container side wall;

wherein each of the center element, and the first outline at least partially defined by the first depression, is centered with respect to the base portion;

wherein a cross-sectional diameter of the first opening to the interior of the container body is less than a cross-sectional diameter of a middle portion of the container side wall;

wherein the base portion defines a diameter that is less than the cross-sectional diameter of the middle portion of the container side wall;

wherein a lower portion of the container side wall extends downwardly from the middle portion of the container side wall to the base portion of the container body, the lower portion along its entirety being greater in diameter than the base portion, including the bottom, thereby rendering the container body stemless;

wherein the container body further comprises a circular neck extending from the container side wall so that the container side wall extends between the circular neck and the base portion;

wherein an upper edge of the container side wall is adjacent to the circular neck of the container body;

wherein the container body further comprises a lip at an end of the circular neck opposite the upper edge of the container side wall;

wherein the circular neck is adjacent to the lip;

wherein a first portion of the lid is above the lip of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein the first circular shape defined by the first portion of the lid is radially positioned between the container side wall and the second circular shape defined by the first portion of the lid;

wherein a second portion of the lid extends horizontally and is positioned so that the second circular shape is radially positioned between the second portion of the lid and the first circular shape;

wherein the second portion of the lid defines a total area across which the second portion of the lid extends horizontally;

wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape;

wherein the arm comprises opposing first and second end portions;

wherein the arm is pivotable from a first position, in which the arm extends horizontally and the weakened or scored area is not deformed, to a second position, in which the arm does not extend horizontally and the weakened or scored area is deformed to provide a second opening to the interior of the container body;

wherein an upper portion of the container side wall extends upwardly from the middle portion of the container side wall to the upper edge of the container side wall, the upper portion along its entirety being greater in diameter than the first opening to the interior of the container body;

wherein the container body contains a liquid therewithin;

wherein the lid cooperates with the lip to provide a seal so that the liquid contained within the container body is sealed against leaking out from between the container body and the lid;

wherein, when the arm of the lid is in the first position and the weakened or scored area is not deformed:

the first end portion of the arm is not positioned above the weakened or scored area of the second portion of the lid; and at least a portion of the second end portion of the arm is positioned above the weakened or scored area of the second portion of the lid;

wherein the container side wall extends between the circular neck and the base portion so that:

the upper portion of the container side wall defines a first angle:

between the upper portion of the container side wall and the bottom of the base portion, and with respect to the bottom of the base portion;

the middle portion of the container side wall defines a second angle:

between the middle portion of the container side wall and the bottom of the base portion, and with respect to the bottom of the base portion;

the lower portion of the container side wall defines a third angle:

between the lower portion of the container side wall and the bottom of the base portion, and with respect to the bottom of the base portion;

the first angle is an acute angle;

the third angle is an obtuse angle;

the second angle is greater than the first angle; and the third angle is greater than the second angle;

wherein the interior of the container body extends continuously across the cross-sectional diameter of the middle portion at a height midway between the circular neck and the base portion so as to be interrupted, if at all, only by the liquid contained within the container body;

wherein the metal is aluminum;

wherein the resin is a polyethylene terephthalate (PET) resin;

wherein the first depression is visible through at least a portion of the container body;

wherein the center element of the base portion is a downward extending protrusion;

wherein the base portion further comprises a second depression adjacent the first depression; and wherein the second depression is visible through the at least a portion of the container body.

16. The container of claim 15, wherein the at least a portion of the container body is transparent.

17. The container of claim 15, wherein the second depression at least partially defines the first outline.

18. The container of claim 17, wherein the base portion further comprises third, fourth, fifth, and sixth depressions; and wherein the third, fourth, fifth, and sixth depressions at least partially define the first outline.

19. The container of claim 18, wherein the downward extending protrusion is centered with respect to the first, second, third, fourth, fifth, and sixth depressions.

20. The container of claim 17, wherein each of the first and second depressions increases in width as the radial distance from a center of the bottom of the base portion increases.

* * * * *